US006820312B1

(12) United States Patent
Senn

(10) Patent No.: US 6,820,312 B1
(45) Date of Patent: Nov. 23, 2004

(54) CONNECTOR ELEMENT FOR END SECTIONS OF PIECES OF CLOTHING TO BE CONNECTED

(75) Inventor: Herbert Senn, Täuffelen (CH)

(73) Assignee: Brero + Co. AG, Biel (CH)

( * ) Notice: Subject to any disclaimer, the term of this patent is extended or adjusted under 35 U.S.C. 154(b) by 144 days.

(21) Appl. No.: 09/958,859

(22) PCT Filed: Oct. 20, 2000

(86) PCT No.: PCT/EP00/10352

§ 371 (c)(1),
(2), (4) Date: Oct. 12, 2001

(87) PCT Pub. No.: WO01/91592

PCT Pub. Date: Dec. 6, 2001

(30) Foreign Application Priority Data

May 28, 2000 (DE) ..... 100 29 232

(51) Int. Cl.[7] ..... A44B 13/00; A41H 37/02; A41F 1/00

(52) U.S. Cl. ..... 24/697.2; 2/321

(58) Field of Search ..... 24/697.1, 633, 24/649, 298, 301, 302, 198, 196; 2/321, 322; 450/79, 73, 82, 92; 156/73.1, 251, 258, 287, 283

(56) References Cited

U.S. PATENT DOCUMENTS 2,034,689 A * 3/1936 Alberts ..... 2/265
2,039,829 A * 5/1936 O'Brien ..... 112/407
2,067,371 A * 1/1937 Allis ..... 112/407
2,681,452 A * 6/1954 Rabinowitz ..... 112/407
3,575,750 A 4/1971 Sakamoto
4,158,584 A * 6/1979 Clarke et al. ..... 156/73.1
4,161,420 A 7/1979 Paschke et al.
4,194,937 A 3/1980 Hashmall
4,617,683 A * 10/1986 Christoff ..... 383/63
4,637,060 A * 1/1987 Ausnit ..... 383/37

FOREIGN PATENT DOCUMENTS

EP 0 084 747 A 8/1983

* cited by examiner

*Primary Examiner*—Robert J. Sandy
(74) *Attorney, Agent, or Firm*—McGlew and Tuttle, P.C.

(57) ABSTRACT

A connection element for end areas particularly of ladies' underwear which are to be connected to one another, especially the end areas of the wings of bras, having an eye tape provided with one or more eyes. The eye tape can be connected to a hook tape. The hook tape has two areas lying one on top of another, wherein one or more hooks are fastened at one area, and the edge zones of both areas extending in parallel to the hooks are connected to one another by means of a separating weld seam. The separating weld seams (10) are arranged within the hook tape (2) between the hook-free area (7) of the hook tape and the hook-carrying area (8).

14 Claims, 2 Drawing Sheets

Fig.9
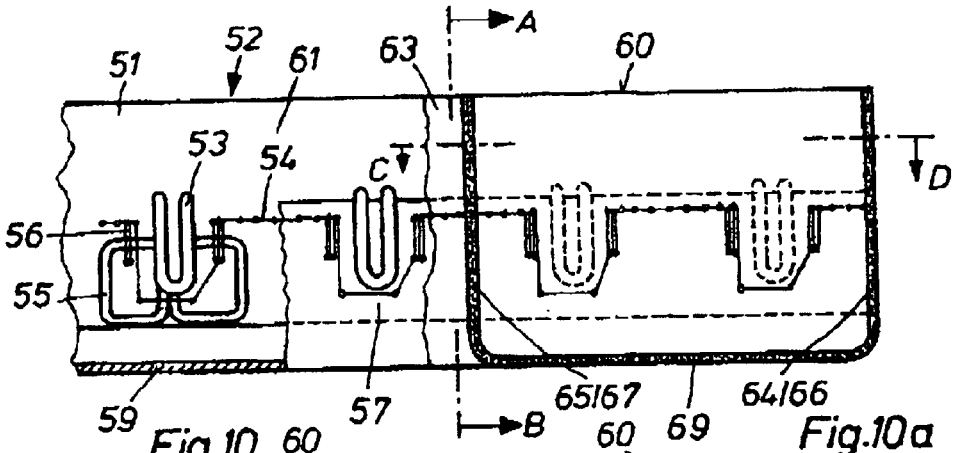
Fig.10
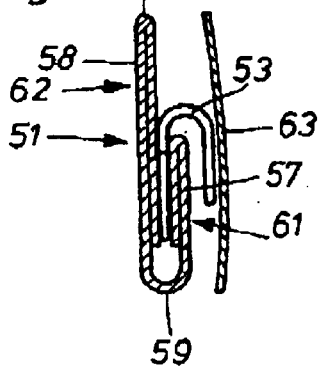
Fig.10a
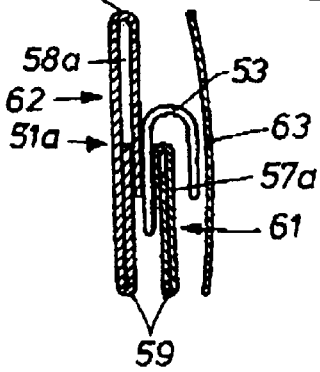
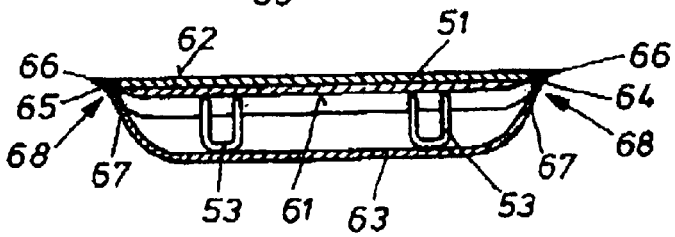
Fig.11
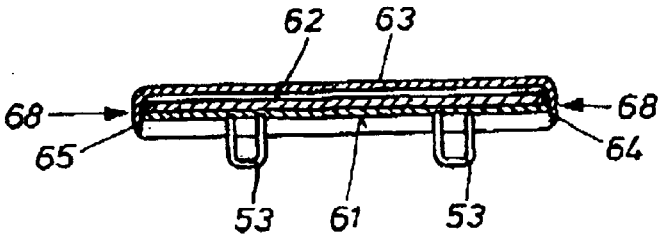
Fig.12

CONNECTOR ELEMENT FOR END SECTIONS OF PIECES OF CLOTHING TO BE CONNECTED

FIELD OF THE INVENTION

The present invention pertains to a connection element for the ends of the support tapes of underwear, e.g., for the ends of the wings on bras.

BACKGROUND OF THE INVENTION

Such connection elements are usually sewn to the ends of the two wings and comprise, in general, an eye tape and a hook tape which can be connected thereto.

In preparing the eye tapes, the eyes are first fastened in the known arrangement on an endless base tape by sewing. To do so, a plurality of so-called fold tapes are sewn in a partially overlapping arrangement to the base tape, which is folded in on its long sides, the eyes being fastened to the base tape or the fold tapes during the sewing on of the fold tapes together with these by seams extending essentially in parallel to the long sides of the base tape. The base tape together with the fold tapes fastened thereto is subsequently divided into individual sections forming the eye tapes by cuts extending at right angles to its longitudinal direction.

In prior-art manufacturing processes, the individual eye tapes are separated from the endless base tape according to the thermal welding method, e.g., an ultrasonic welding method, so that the cut edges of the base tape and of the fold tapes are connected to one another simultaneously. Even though this manner of cutting off of the eye tapes from the endless base tape and the likewise endless fold tapes is simple in terms of the manufacturing technology and correspondingly favorable in terms of costs, a hard and also very sharply outlined connection edge is formed as a result. Since the base tape and the fold tapes are separated from one another by the cuts directed at right angles to their long sides, these connection edges form the long-side edges of the eye tapes.

In the case of underwear worn directly on the skin, e.g., in the case of bras, whose wings lie on the skin with a certain force, there is therefore a risk that the connection edges of the eye tapes, which also lie on the skin, cut into the skin. This results in an unpleasant feeling during wear, which may also lead to skin irritations.

The conditions are similar in the case of the hook tapes, for the manufacture of which a likewise endless base tape is used. This is first shaped into a kind of tube by folding in its two long sides, its folded-in areas slightly overlapping and having essentially equal width. The hooks to be arranged in the overlapping area are fastened to the base tape by means of a seam likewise extending essentially in parallel to the long sides of the base tape, all layers of the base tape lying one on top of another being connected to one another simultaneously.

The base tape with the hooks fastened thereto is divided into individual sections forming the hook tapes by cuts extending at right angles to the longitudinal direction as well. Before the cutting off of the individual hook tapes, the base tape is folded essentially centrally around a folding edge extending essentially in parallel to its longitudinal direction, and its area carrying the hooks lies on the area that is free from hooks.

If the separation of the individual hook tapes from the endless base tape is likewise carried out according to the thermal welding method, the cut edges of the areas of the base tape located one on top of another are connected to one another by the separation operation. Since the cut edges extend at right angles to the long sides of the base tape in this case as well, these connection edges also form the front-side edges of the hook tapes thus prepared. Thus, the connection edges of the hook tapes also cause an unpleasant feeling during wear, which may lead to skin irritations, in the case of underwear to be worn directly on the skin.

SUMMARY AND OBJECTS OF THE INVENTION

The basic object of the present invention is to provide a connection element for the support tapes of underwear, e.g., for the ends of wings on bras, whose hook and eye tapes have no sharply outlined connection edges, even though it can be manufactured according to a thermal welding method.

Based on a hook tape of this type, this object is accomplished for the hook tape by the separating weld seams being arranged within the hook tape between its hook-free area and the hook-carrying area.

Such an arrangement of the separating weld seams can be obtained in a simple manner if the separating weld seams are formed with the hook-free area lying on the hook-carrying area and by these having been brought into the area between the two areas by turning/concealing the hook tape. The separating weld seams are thus brought into the interior of the hook tape, so that the edge zones which can come into contact with the skin are formed by the nonwelded material of the hook tape.

Endless manufacture of the hook tapes can be achieved using an endless base tape provided with hooks if the base tape is folded, prior to the separation of a section, in the area of its free end around a fold line extending essentially in parallel to its longitudinal axis such that its hook-free area lies on the hooks and the section is subsequently cut off by the separating weld seams. The areas lying one on top of another are now connected to one another along their cut edges, so that the hook tape thus formed can then be turned/concealed such that the separating weld seams will come to lie within the hook tape between the two areas.

It is advantageous in this connection for the fold line to extend within the hook-free area at a laterally spaced location from the fastening seam.

Based on an eye tape of this type, this object is accomplished for the eye tape by the eye tape having a cover tape, which is arranged at its eye-free area and which is connected to same by means of the separating weld seams, the separating weld seams being arranged within the eye-free area of the eye tape between this and the cover tape.

Such an arrangement can be obtained if the separating weld seams are formed with the cover tape lying on the eye-carrying area and the separating weld seams having been brought into the area between its eye-free area and the cover tape by turning/concealing the eye tape.

By arranging a cover tape at the eye-free area of the cover tape, not only are the connection edges, which are outlined especially sharply due to the separating weld seam, brought into the interior of the eye tape, but, in particular, the fastening seams for the eyes are also covered by the cover tape, as a result of which the wearing comfort of the eye tape is further increased.

To form the separating weld seam fastening the cover tape on the eye tape in the area of the base tape as much as possible, it is advantageous for the cover tape to consist of an elastic material, preferably an elastic fabric.

Endless manufacture of the eye tapes using a base tape provided with eyes, from which base tape corresponding sections are cut off by separating weld seams, can be achieved if a cover tape is placed on the eye-carrying area of the base tape in the area of the free end of the base tape prior to the cutting off of a section and the sections of both the base tape and the cover tape are subsequently cut off by the separating weld seams, the base tape and the cover tape are connected to one another along their cut edges, and the eye tape thus formed is then turned/concealed such that the separating weld seams come to lie between the eye-free area of the eye tape and the cover tape.

Thus, despite the fact that the endless manufacture is maintained, the separating weld seams are brought into the interior of the eye tape, so that the edge zones which can come into contact with the skin are formed by the cover tape which is not welded on its outer side.

Based on a hook tape of this type, the object according to the present invention is accomplished for the hook tape by the hook tape having a cover tape which is arranged at its hook-free area and is connected to same by means of the separating weld seams, the separating weld seams being arranged within the hook-free area of the hook tape between this and the cover tape.

Such an arrangement can be obtained if the separating weld seams are formed with the cover tape lying on the hook-carrying area and the separating weld seams being brought into the area between the hook-free area of the hook tape and the cover tape by turning/concealing the hook tape.

By arranging a cover tape at the hook-free area of the cover tape, not only are the connection edges, which are especially sharply outlined due to the separating weld seam, brought into the interior of the hook tape, but, in particular, the fastening seams for the hooks are also covered by the cover tape, as a result of which the wear comfort of the hook tape is further increased.

To form the separating weld seam fastening the cover tape on the hook tape in the area of the base tape as much as possible, it is advantageous for the cover tape to consist of an elastic material, preferably an elastic fabric.

Endless manufacture also of the hook tapes using a base tape provided with hooks, from which corresponding sections are cut off by separating welding, can be achieved if a cover tape is laid on the hook-carrying area of the base tape in the area of the free end of the base tape before the cutting off of a section and the sections of both the base tape and the cover tape are subsequently cut off by the separating weld seams, the base tape and the cover tape are connected to one another along their cut edges, and the hook tape thus formed is subsequently turned/concealed such that the separating weld seams come to lie between the hook-free area of the hook tape and the cover tape.

Thus, despite the fact that the endless manufacture is maintained, the separating weld seams are brought into the interior of the hook tape, so that the edge zones which can come into contact with the skin are formed by the cover tape which is not welded on its outer side.

Further details and advantages of the present invention will appear from the following description of the exemplary embodiments of the present invention which are shown in the attached drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a partial cutaway view showing a first embodiment of a hook-carrying base tape of a hook tape as an endless tape with folded end;

FIG. 2 is a cross sectional view of the still unfolded base tape of the hook tape;

FIG. 3 is a view of the hook tape after the separating welding operation;

FIG. 4 is a view of the hook tape after the turning/concealing operation;

FIG. 5 is a sectional view along line B—B in FIG. 1;

FIG. 6 is a view of a base tape of an eye tape with a cover tape as an endless tape;

FIG. 7 is a sectional view along line A—A in FIG. 6 with the cover tape welded on;

FIG. 8 is a view of an eye tape after the turning/concealing operation;

FIG. 9 is a view of a second embodiment of a hook tape according to the present invention with the cover tape welded on in its front area;

FIG. 10 is a sectional view along line 1A–B in FIG. 9,

FIG. 10*a* is a view, corresponding to FIG. 10, of another embodiment of the hook tape formed by two tapes;

FIG. 11 is a sectional view along line C–D in FIG. 9 after the separating welding operation; and FIG. 12 is a sectional view along line C–D in FIG. 9 after the separating welding and turning/concealing operations.

DESCRIPTION OF THE PREFERRED EMBODIMENTS

Figures 1, 2, 3, 4, 5, 6, 7, 8:
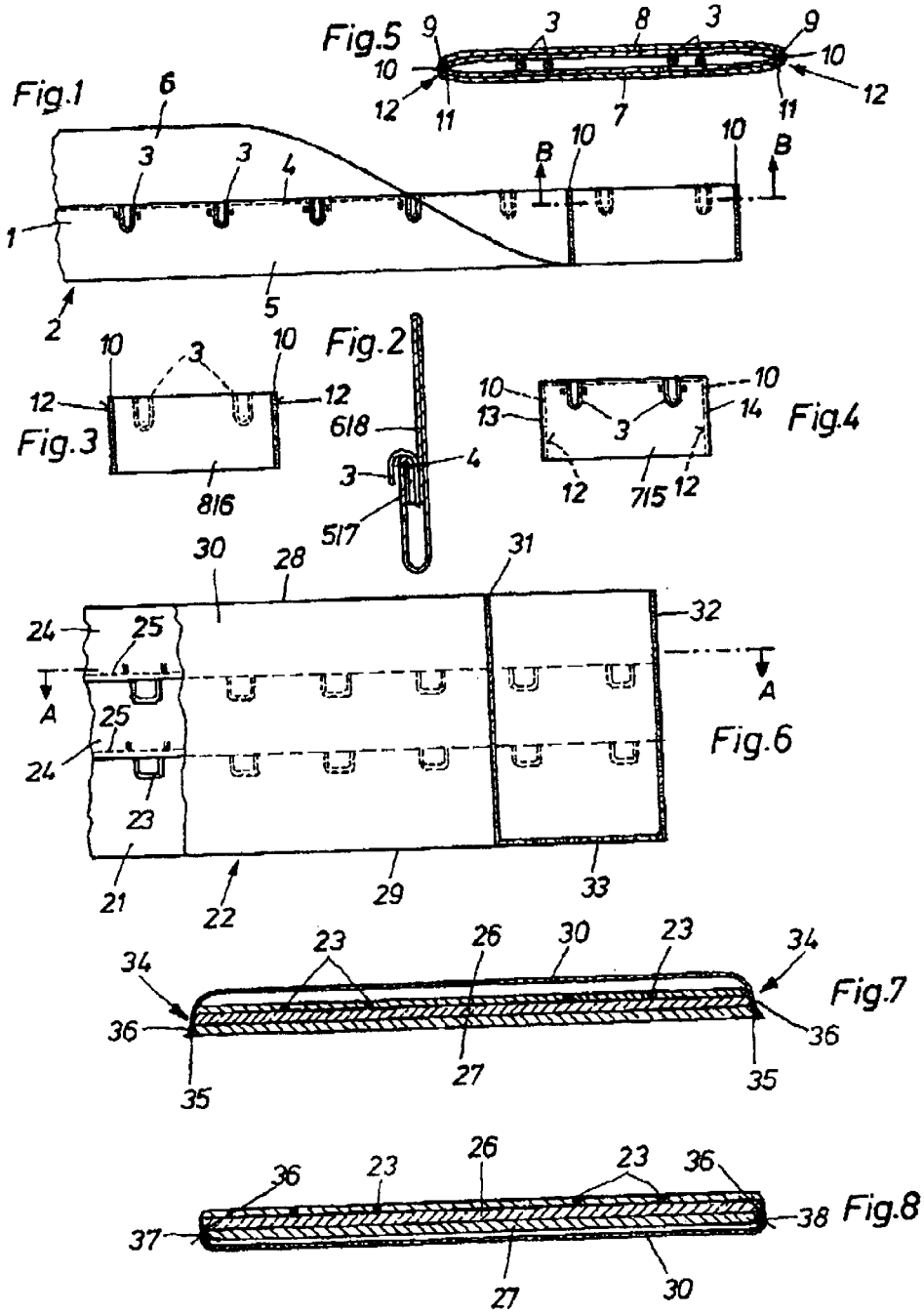

Referring to the drawings in particular, FIG. 1 shows a base tape 1 of a hook tape 2, which is provided with coupling elements as hooks 3 at predetermined distances. These are fastened to the base tape 1 by means of a fastening seam 4 extending essentially in parallel to the longitudinal axis of the base tape 1, the longitudinal axis of the hook 3 extending essentially at right angles to the longitudinal axis of the base tape 1. In the exemplary embodiment shown, the side areas of the base tape 1 are folded onto one another and overlap each other by a certain amount. The side area 5 of the base tape 1 located on top in FIG. 2 can be folded over once again to the inside to form a clean edge and lies on the side area 6, which is longer compared with it. The fastening seam 4 is used at the same time to fix these folds of the base tape 1, which thus represents a tubular body with overlapping hems. An insert tape may be provided within the base tape 1.

The short side area 5 thus forms a hook-carrying area 7, while the longer side area 6 forms a hook-free area 8. The areas 7 and 8 may have different or equal size.

The front end of the base tape 1 is folded in FIG. 1 along a predetermined length around a fold line formed preferably by the fastening seam 4 such that the hook-free area 8 lies on the hook-carrying area 7. The hooks 3 are therefore covered by the hook-free area 8 in the area of this folding.

In this position of the areas 7 and 8, consecutive sections of a predetermined length are cut off from the base tape 1 according to a thermal welding method, e.g., by means of ultrasound. The length of these sections determines—relative to the position of use of the hook tape 2 to be prepared, e.g., in bras—the height and width of the hook tape 2.

The separating welding tool used for this is designed such that it forms a separating weld seam 10 each at both a first section and a second section following this during the separation operation. The cut edges 9 of the hook-carrying area 7 formed as a result are therefore welded to the cut edges 11 of the hook-free area 8, and a hardened and also very sharply outlined connection edge 12 is formed, which is located on the respective outer side of the corresponding section. The hooks 3 are still covered by the hook-free area 8 (FIGS. 3 and 5).

The section is concealed by a concealing operation following this such that the hooks 3 are released from the hook-free area 8, on the one hand, and the connection edges 12 (separating weld seams 10) come to lie in the interior of the finished hook tape 2, on the other hand, so that the two limiting edges 13, 14 of the hook tape 2 which come into contact with the skin in the position of use of the hook tape 2 are formed by the material of the base tape 1 (FIG. 4).

The hook tape 2 thus prepared can be sewn in the known manner to the support tape of a piece of clothing, e.g., to the wings of a bra. Relative to the position of use of the bra, the two limiting edges 13, 14 now form the upper and lower areas of the hook tape 2 sewn onto the wings.

FIG. 6 shows a base tape 21 of an eye tape 22, which is provided with coupling elements as eyes 23 at predetermined distances. As is apparent from FIG. 6, a plurality of fold tapes 24 extending in parallel to the longitudinal axis of the base tape are sewn onto the base tape 21 by means of fastening seams 25 extending in parallel to the fold tapes. The fastening seams 25 are used at the same time to fasten the eyes 23 on the base tape 21, the longitudinal axis of the fastening seams extending essentially at right angles to the longitudinal axis of the base tape 21. Thus, the base tape has an eye-carrying area 26 on one of its sides and an eye-free area 27 on its other side.

The base tape 21 is preferably prepared from a soft material and may be formed by a flat tape, whose side areas, not shown specifically in the drawing, are folded onto one another and overlap by a certain amount. The base tape 21 thus represents a tubular body with overlapping hems. An insert tape may be provided within the base tape 1. The folded edges 28, 29 of the base tape 21 thus represent—relative to the position of use of the eye tape 22 in case of its use in bras—the two front-side limitations of the eye tape 22.

As is apparent from FIG. 6, a cover tape 30, which covers the eyes 23, is placed on the eye-carrying area 26 of the base tape 21.

In this position of the base tape 21 and the cover tape 30, sections of predetermined length are cut off from the base tape 21 according to the thermal welding method. The length of these sections determines—relative to the position of use of the eye tape 22 to be prepared, e.g., in bras—the height and the width of the eye tape 22.

The separating welding tool used is likewise designed in this case such that it forms a respective separating weld seam 31 and 32 at both a first section and a second section following this during the separation operation. The cut edges 34 of the eye tape 22 which are formed as a result are therefore welded to the cut edges 35 of the cover tape 30, and a hardened and also very sharply outlined connection edge 36, which is located on the respective outer side of the corresponding section, is formed. The eyes 23 are still covered by the cover tape 30 welded on.

The section is turned/concealed by a turning/concealing operation following this such that the cover tape 30 comes to the eye-free area 27 from the eye-carrying area 26. The eyes 23 are exposed as a result. At the same time, the connection edges 36 (separating weld seams 31, 32) come to lie in the interior of the finished eye tape 22, so that the two limiting edges 37, 38 of the eye tape 22 which come into contact with the skin in the position of use of the eye tape 22 are formed by the cover tape 30.

The eye tape 22 thus prepared can be sewn in the known manner to the support tape of a piece of clothing, e.g., to the wings of a bra. Relative to the position of use of the bra, the two limiting edges 37, 38 form the upper and lower area of the eye tape 22 sewn to the wings.

It was assumed above that one separating weld seam each is formed on two sections during the cutting off of the individual sections of both the hook tape 2 and the eye tape 22. This can be done by means of a relatively simple separating welding tool. Moreover, any waste of base tape 21 is avoided.

However, the use of a shape separation welding tool to cut off the individual sections of the hook tape 2 and the eye tape 22 is obviously within the scope of the present invention. It would thus be possible to form the two separating weld seams simultaneously at the section in question.

In this case, the shape separation welding tool used to cut off the sections of the base tape 1 of the hook tape 2 should only be provided with two straight sonotrodes to be arranged at a distance corresponding to the length of the individual sections.

To cut off the sections from the base tape 21 of the eye tape 22, it is possible to use an essentially U-shaped sonotrode, with which the two separating weld seams 31, 32 and at the same time a cross weld seam 33 extending between these can be prepared. The two separating weld seams 31 and 32 can be prepared now with the two legs of the U-shaped sonotrode, which extend in parallel to one another, while the cross weld seam 33, which may be designed as a standard weld seam (i.e., not as a separating weld seam), can be prepared with the cross web connecting the two legs in the area of one of the two folded edges 28, 29.

Even though a hardened connection edge, which can be considered to be disadvantageous at first, is also formed in the area of the corresponding folded edge 29 as a result, this disadvantage is eliminated because this connection edge comes to lie between the eye-free area 27 of the eye tape 22 and the cover tape 30 due to the turning/concealing of the eye tape 22, and the advantage is achieved at the same time that the corresponding folded edge is hardened. If the cross weld seam 33 is provided in the area of the end of the eye tape 22 which end will not be connected later to the corresponding support tape, this hardening of the corresponding folded edge contributes to an improvement in the appearance of the eye tape 22.

FIG. 9 shows a base tape 51 of a second embodiment of a hook tape 52, whose hooks 53 are arranged at predetermined distances and are sewn to the base tape 51 by means of a fastening seam 54. The longitudinal axis of the hooks 53 extends essentially at right angles to the longitudinal axis of the base tape 51, so that the fastening seam 54 extends essentially in parallel to this. In the area of the sew-on eyes 55 of the hooks 53, the fastening seam 54 has sections 56 which extend at right angles to the longitudinal axis of the base tape 51 and which are connected to one another by means of connection stitches, not specifically identified.

The base tape 51 may be formed from a flat tape, whose two end areas are first folded onto each other, and the end of the shorter leg 57 formed as a result is folded over again to the inside and lies on the end of the longer leg 58, so that the two legs 57, 58 overlap by a certain amount and the base tape 51 represents a kind of tubular body, in which an insert tape may be provided.

In another embodiment, the base tape 51 may also be prepared in a different manner. FIG. 10*a* shows a base tape 51*a,* which is formed by two tapes 57*a* and 58*a*. The tape 57*a* corresponds here essentially to the short leg 57 of the base tape 51, while the tape 58*a* corresponds to the long leg 58 of the base tape 51.

As is apparent in this connection from FIG. 10*a,* the two end areas of the tape are folded onto one another such that its shorter end area lies on the longer end area. By contrast, the end areas of the tape 58*a* are folded onto one another such that its longer end area lies on the shorter end area. The hooks 53 are fastened between the two tapes 57*a,* 58*a* by means of a corresponding fastening seam 54 in this case as well, and the two tapes 57*a,* 58*a* may be connected to one another either by the fastening seam 54 and/or by a separate seam.

Regardless of the type of preparation of the base tape 51 and 51*a,* their folded edges 59, 60 thus represent—relative to the position of use of the hook tape 52 in the case of its use in bras—the two front-side limitations of the hook tape 52.

Both the base tape 51 and the base tape 51*a* thus have a hook-carrying area 61 on one of their sides and a hook-free area 62 on their other sides.

Since the different embodiments of the base tape 51 and of the base tape 51*a* have no effect on the applicability of the teaching according to the present invention, reference will be made below to the base tape 51 only.

As is apparent from FIG. 9, a cover tape 63, which covers the hooks 53 and extends over the entire width of the base tape, is placed on the area of the base tape 63 thus prepared, which is the right-hand area in the drawing.

In this position of the base tape 51 and cover tape 63, sections of a predetermined length are cut off consecutively from the base tape 51 according to the thermal welding method. The length of these sections determines—relative to the position of use of the hook tape 52 to be prepared, e.g., in bras—the height and the width of the hook tape 52.

The separating welding tool used is designed such in this case as well that it forms a separating weld seam 64 and 65 on both a first section and a second section following same during the separation operation. The cut edges 66 of the hook tape 52 which are formed as a result are therefore welded to the cut edges 67 of the cover tape 63, and a hardened and also very sharply outlined connection edge 68 is formed, which is located on the respective outer side of the corresponding section. The hooks 53 are still covered by the cover tape 63 welded on.

The section is turned/concealed by a turning/concealing operation which follows this such that the cover tape 63 comes from the hook-carrying area 61 to the hook-free area 62. The hooks 53 are exposed as a result. At the same time, the connection edges 68 (separating weld seams 64/65) come to lie in the interior of the finished hook tape 52, so that the two limiting edges 59, 60 of the hook tape 52, which come into contact with the skin in the position of use of the hook tape 52, are formed by the cover tape 63.

The hook tape 52 thus prepared can be sewn in the known manner to the support tape of a piece of clothing, e.g., to the wings of a bra. Relative to the position of use of the bra, the two limiting edges 59, 60 form the upper and lower areas of the hook tape 52 sewn to the wings.

It was assumed above that one separating weld seam each is formed on two sections during the separation of the individual sections of the hook tape 52. This can be performed with a relatively simple separating welding tool. Moreover, any waste of base tape 51 is avoided.

However, the use of a shape separation welding tool to cut off the individual sections of the hook tape 52 is obviously within the scope of the present invention. It would thus be possible to form the two separating weld seams simultaneously at the section in question.

In this case, the shape separation welding tool used to cut off the sections of the base tape 51 of the hook tape 52 should only be provided with two straight sonotrodes to be arranged at a distance corresponding to the length of the individual sections.

To cut off the sections of the base tape 51 of the hook tape 52, it is also possible in this case to use an essentially U-shaped sonotrode, with which the two separating weld seams 64, 65 and at the same time a cross weld seam 69 extending between these can then be prepared. The two separating weld seams 64, 65 can be prepared with the two legs of the U-shaped sonotrode, which extend in parallel to one another, while the cross weld seam 69, which may be designed as a standard weld seam (i.e., not as a separating weld seam), can be prepared with the cross web connecting the two legs in the area of one of the two folded edges 59, 60.

Even though a hardened connection edge is likewise formed as a result in the area of the corresponding folding edge 59, which can be considered to be disadvantageous at first, this disadvantage is eliminated because this connection edge comes to lie between the hook-free area 62 of the hook tape and the cover tape 63 due to the turning/concealing of the hook tape 52, and the advantage is achieved at the same time that the corresponding folded edge is hardened. If the cross weld seam 69 is provided in the area of the end of the hook tape 52 which end is not connected later to the corresponding support tape, this hardening of the corresponding folded edge contributes to an improvement in the appearance of the hook tape 52.

while specific embodiments of the invention have been shown and described in detail to illustrate the application of the principles of the invention, it will be understood that the invention may be embodied otherwise without departing from such principles.

What is claimed is:

1. A clothing closure connection element comprising:

a first tape having a first and second side;

a coupling element arranged on said first side of said first tape, wherein said coupling element is one of a hook and an eye;

a second tape arranged adjacent said second side of said first tape, said second tape being connected to said first tape by a weld seam, said weld seam being arranged between said first and second tapes.

2. A connection element in accordance with claim 1, wherein:

said second tape has first and second sides, said second side of said second tape being arranged adjacent said second side of said first tape, said first side of said second tape being adjacent said first tape at said weld seam.

3. A connection element in accordance with claim 2, wherein:

said weld seam is a harder material than one of said tapes;

said weld seam is arranged between said first and second tapes by welding said tapes together when said first side of said first tape is adjacent said first side of said second tape, and then turning said welded tapes inside out to have said second side of said first tape be adjacent said first side of said second tape.

4. A connection element in accordance with claim 1, wherein:

said weld seam is a harder material than one of said tapes made of an elastic fabric.

5. A connection element in accordance with claim 1, wherein:

said weld seam is arranged between said first and second tapes by welding said tapes together when said first side of said first tape is adjacent said first side of said second tape, and then turning said welded tapes inside out to have said second side of said first tape be adjacent said first side of said second tape.

6. A bra connection element with improved tactile sensation, the bra connection element comprising:

a base tape defined by a front side, a back side, a top and a bottom edge, and two side edge zones;

a coupling element fastened to said front side of said base tape, wherein said coupling element is one of a hook tape and an eye tape;

a cover tape defined by a front side, a back side, a top and a bottom edge, and two side edge zones, wherein said cover tape is joined with said base tape into a welded tape by welding said two side edge zones of said base tape with said two side edge zones of said cover tape with said front side of said base tape adjacent to said front side of said cover tape; and said welded tapes are turned inside out to have said back side of said base tape be adjacent said back side of said cover tape, such that said welded tape has a separating weld seams disposed between said back side of said base tape and said back side of said cover tape.

7. A connection element for end areas of wings of bras, the connection comprising:

a base tape;

a hook tape provided with one or more hooks;

an eye tape with eyes fastened to said base tape by one or more fastening seams, edge zones of said eye tape extending in parallel to a longitudinal direction of the eyes, each of said edge zones having a separating weld seam;

a cover tape arranged at an eye-free area of said eye tape, said cover tape being connected to said eye tape by said separating weld seams, wherein said separating weld seams of said eye tape are arranged between said eye-free area of said eye tape and said cover tape.

8. A connection element in accordance with claim 7, wherein said separating weld seams are formed with said cover tape lying on an eye-carrying area and said separating weld seams are brought in between said eye-free area of said eye tape and said cover tape by concealing said eye tape.

9. A connection element in accordance with claim 7, wherein said cover tape consists essentially of an elastic material, preferably an elastic fabric.

10. A connection element in accordance with claim 7, wherein said separating weld seam is provided in the area of at least one folded edge of said eye tape.

11. A connection element in accordance with claim 7, wherein corresponding sections are cut off from a base tape provided with eyes to form said eye tape, wherein said cover tape is placed on an eye-carrying area of said base tape in the area of its free end before the separation of a section, the sections of both said base tape and said cover tape are subsequently cut off by said separating weld seams, wherein said base tape and said cover tape are connected to one another along their cut edges, and said eye tape thus formed is then concealed such that said separating weld seams come to lie between said eye-free area of said eye tape and said cover tape.

12. A connection element in accordance with claim 7, wherein said eye tape is a multilayer eye tape, each said separating weld seam of each of said edge zones also connecting to individual layers of said eye tape.

13. A connection element in accordance with claim 7, wherein said cover tape consists essentially of an elastic fabric.

14. A process for preparing a connection element, the process comprising the steps of:

providing an eye base tape;

fastening a coupling element to said base tape by a fastening seam to provide an coupling carrying area at one side and coupling free area at another side;

providing a cover tape arranged adjacent to base tape on said coupling carrying area;

connecting the cover tape to said base tape with separating weld seams wherein sections of said base tape and the cover tape are cut off by the separating weld seams with said base tape and the cover tape connected to one another along cut edges by the weld seams; and turning the sections inside out such that the tape formed has separating weld seams disposed between said coupling free area and the cover tape.

* * * * *